United States Patent [19]

Badoz et al.

[11] 4,291,935

[45] Sep. 29, 1981

[54] SELF-STRIPPING CONTACT ELEMENT FOR A CONNECTOR

[75] Inventors: Jean-Marie Badoz; Daniel Merceron, both of Suresnes, France

[73] Assignees: Socapex; Souriau & Compagnie, both of Boulogne, France

[21] Appl. No.: 24,363

[22] Filed: Mar. 27, 1979

[30] Foreign Application Priority Data

Mar. 31, 1978 [FR] France ..... 78 09569

[51] Int. Cl.[3] ..... H01K 11/20

[52] U.S. Cl. ..... 339/97 R

[58] Field of Search ..... 339/223 R, 97–99, 339/96, 103 R, 97 R, 97 P

[56] References Cited

U.S. PATENT DOCUMENTS 3,027,536 3/1962 Pasternak ..... 339/97 R 3,805,214 4/1974 Demler ..... 339/97 R X 3,848,954 11/1974 Sedlacek ..... 339/97 R 3,902,154 8/1975 McKee ..... 339/103 R X 3,976,350 8/1976 Keglewitsch ..... 339/97 P

FOREIGN PATENT DOCUMENTS 197809 9/1978 United Kingdom ..... 339/97 R 2004425 3/1979 United Kingdom ..... 339/97 R

*Primary Examiner*—John McQuade

*Assistant Examiner*—John S. Brown

*Attorney, Agent, or Firm*—Cushman, Darby & Cushman

[57] ABSTRACT

A contact element of the self-stripping type, bearing two slots (15) and (17) into which the wires are radially introduced, and an additional radial anchoring slot (19) in the form of an interrupted ring of which the sides are elastic, due to a resilient region (D), and comprise regions (A, B, C) for introducting, shaping and radially anchoring the wire.

4 Claims, 5 Drawing Figures

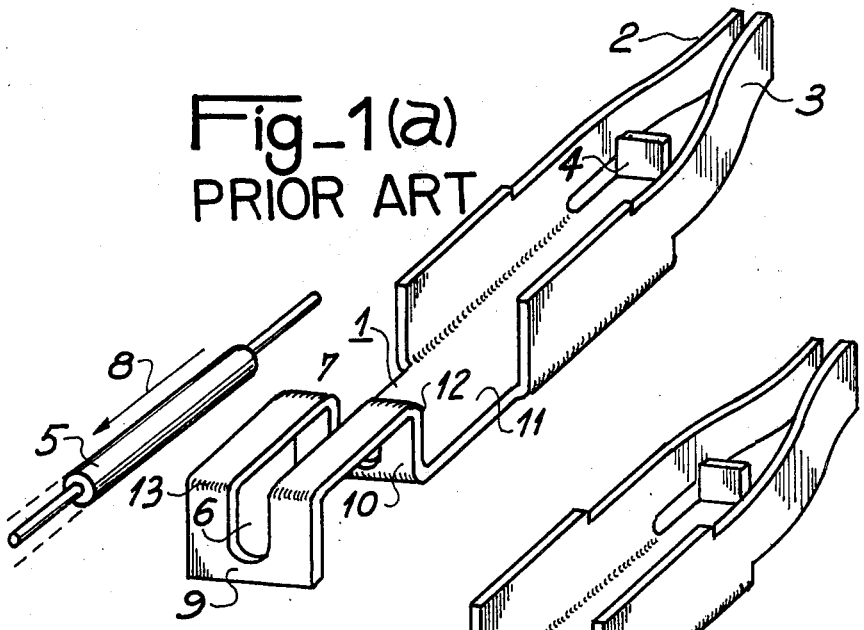
Fig_1(a)
PRIOR ART
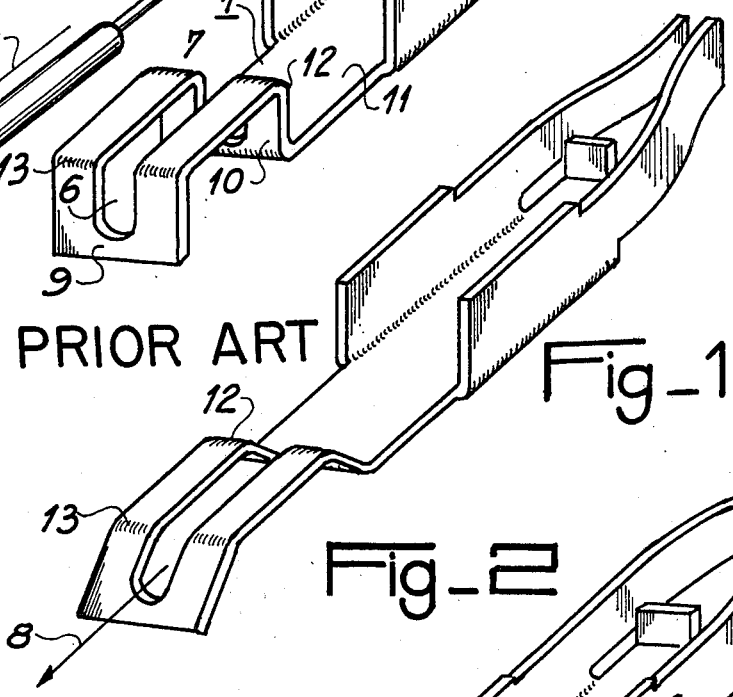
PRIOR ART
Fig_1(b)
Fig_2
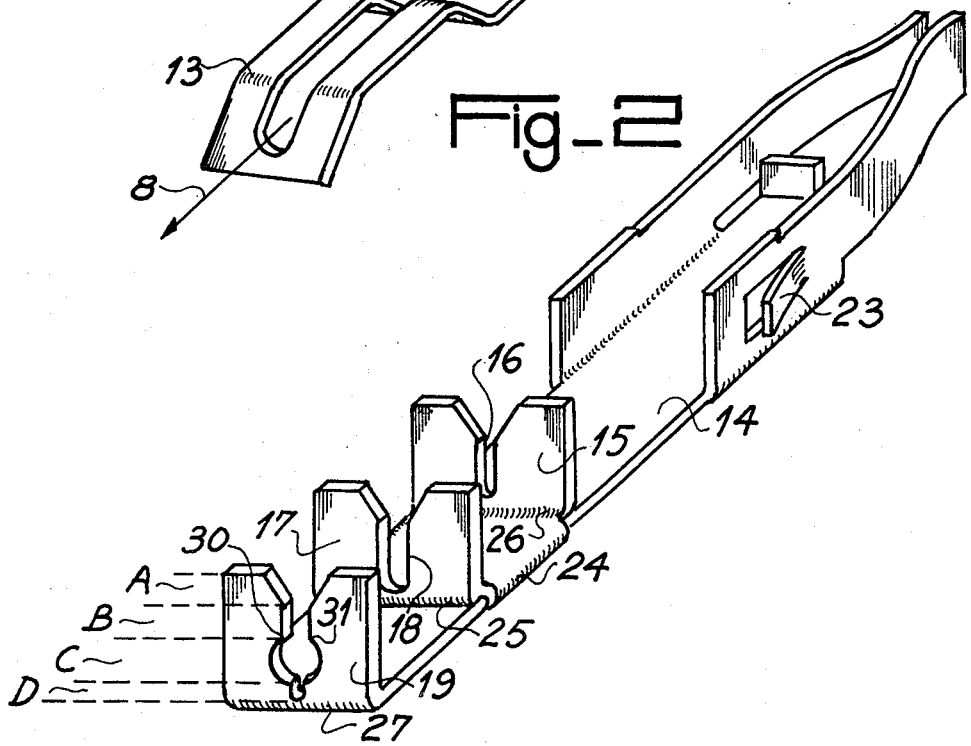

SELF-STRIPPING CONTACT ELEMENT FOR A CONNECTOR

This invention relates to electrical connectors for connecting circuits of which the ends to be connected are in the form of conductive wires. In this case, the connectors comprise contact elements fixed in an insulating support which have to be connected to wires, one of the important industrial features of these connectors being the rapidity and the low cost of the connections established in this way. Connections of this type are now being increasingly formed by straightforward wedging or gripping in an open U-shaped or V-shaped slot formed in part of the contact.

In numerous applications, this wedging of the conductive part of the wire, which establishes the actual electrical connection, is achieved without any need to remove or strip the insulating coating by which the wire is normally covered. In a first step, a slot cuts through this insulation and then grips the metallic part of the wire, which constitutes the important feature of self-stripping. However, in the majority of existing products, a second slot responsible for the mechanical stability of the wire protects the electrical connection against the longitudinal stresses which can be accidentally applied to the wire. However, the mechanical anchorage provided by this second slot is very weak in the face of accidental radial stresses.

The object of the present invention is to obviate this disadvantage. By incorporating an additional metal part directly integrated with the contact, the invention provides for a much stronger mechanical anchorage capable of withstanding radial stresses. The results of tests indicate performance levels at least 2 to 3 times higher than those obtained with products which do not have this metal part. Basically, this metal part is formed by an interrupted ring of which the opening faces in the same direction as that of the first two slots.

More particularly, the present invention relates to a radially anchored self-stripping contact element for connectors for wires covered by an insulating sheath comprising a front portion which establishes the contact with a complementary contact element belonging to another circuit and a rear portion establishing the connection with the wire, this portion comprising open slots where said self-stripping effect and said connection are obtained by introduction of the wire, wherein said rear portion successively comprises three parallel walls provided with slots of different width which are respectively responsible for the electrical connection, for mechanical stability with respect to axial stresses and for mechanical stability with respect to radial stresses, the third radial anchoring slot being in the form of an interrupted ring.

The invention will be better understood from the following description in conjunction with the accompanying drawings, wherein:

FIG. 1(*a*) (*b*) shows a self-stripping contact element according to the prior art.

FIG. 2 shows one embodiment of a contact element according to the invention.

Figure 3:
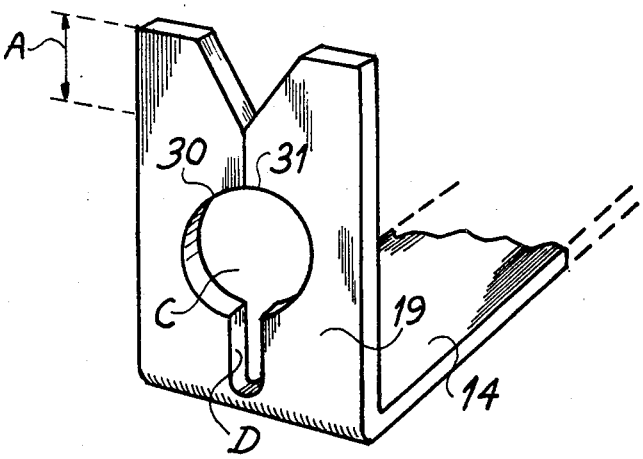
FIG. 3 shows another embodiment.

FIG. 1 (*a*) (*b*) shows a self-stripping contact element according to the prior art. It comprises a front portion

1 which, through the wedging effet of its elastic parts 2 and 3, ensures contact with a complementary contact element (not shown) introduced between the elastic parts to a depth limited by the stop 4, and a rear portion ensuring the connection with a insulating coated wire 5. The connection is established by introducing the wire into slots 6 and 7, of which one (7) cuts the insulating coating by its edges and creates an electrical contact with the conductive wire, whilst the other (6) wedges or grips the coating of the wire and thus fixes or anchors the wire in the longitudinal direction to withstand the mechanical forces, for example axial tractive forces, accidentally applied to the wire 5 in the direction of the arrow 8.

In the prior art, these slots are formed in walls 9 and 10 obtained by bending or folding a flat strip 11. However, a structure such as this has a serious disadvantage where the contact element is to be reduced below a certain scale for practical applications. This is because, for given tractive forces, the thicknesses of its constituent metallic walls and, hence, their mechanical strength decreases, particularly in the region of the folds 12 and 13.

This results in a risk of deformation, as illustrated in FIG. 1 (*b*), with the serious consequences of definitive deterioration of the contact element.

FIG. 2 shows a contact element according to the invention. This contact element which is supported by an insulating block (not shown), is designed to receive in its rear portion 1, of the female type, a pin of the male type belonging to another insulating block (not shown). The rear portion 14 ensures the connection with a coated wire. The connection is established by wedging or gripping, according to the mode of operation indicated above, the first transverse wall 15 having a contact slot 16, which establishes the actual electrical contact, and a second transverse wall 17 having an anchoring slot 18 which is wider than the first slot and which, by wedging the insulating coating, mechanically anchors the wire against the axial stresses accidentally applied thereto.

A third transverse wall 19 represents the characteristic element of the invention by virtue of the slot-like opening with it comprises. This slot, which is variable in width, comprises several regions, each performing a predetermined function.

The function of the region A, of which the sides are V-shaped, is progressively to compress the insulating coating without cutting it for the purpose of adapting it to the dimensions of the following region B.

The function of the narrow region B is to shape the insulating coating with a minimum transverse dimension free from any cuts.

The region C of larger dimensions similar to, but smaller than, the cross section of the elastic coating; its contour may be curvilinear or polygonal.

Finally, the region D which is narrower than the region C and of which the function is to enable the slot as a whole to be elastically widened to a certain extent when the coated wire is introduced.

Accordingly, this wall as a whole has the appearance of a ring which is is interrupted or open over part of its contour.

A ring such as this, which will be referred to hereinafter as a radial anchoring fork in the interests of simplicity, operates in the following manner:

A coated wire introduced by its lateral face at A undergoes progressive compression to a given diameter.

It then passes through the region B having substantially parallel sides where it is shaped. Finally, it arrives in the region C of which the annular form and the dimensions similar to its own cross-section enable its external coating to return to a diameter similar to its normal diameter by virtue of the elasticity of its constituent material.

The effect of an overall structure such as this is that, after passing the region B, the wire is advantageously anchored with respect to radially directed forces.

In the only direction where a radially directed force might endanger this anchorage, namely the direction of the slot through which the wire is introduced into the ring, the portions 30 and 31 or the region C, which are substantially perpendicular to this direction, receive and support the lateral face of the wire without any danger of the ring being opened as a result of this perpendicularity.

FIG. 3 shows a variant of the invention. In this connection, it is pointed out that the elasticity of the constituent material of the wire which, in the foregoing description, was utilised solely in the operation of the annular fork, may co-operate completely or in part with another elastic means, namely that represented by the branches of the fork itself and the region where they join one another at the base of the fork. The function performed by the region D is to adjust through its length the elasticity of the conductive material of which the annular fork is made.

In this variant, the width of the shaping or forming region B may be selected independently of the requirement that the insulating material of the wire should not be cut and may decrease to the point where the two sides of this region are in contact.

In this case, the radial anchorage is completely ensured by the complete closure of the opening C of the ring.

It is important to note that, throughout the foregoing description, the radial anchoring fork has been primarily described as essentially performing this function. However, it is also possible in accordance with the invention for the anchoring fork to be made to perform a longitudinal anchoring function in a certain number of industrial applications, in which case the zones where the two functions are performed are delimited by the relative dimensions between the cross-section of the coated wire and that of the region C of the annular fork, so that the wire is positively wedged by ring C.

Figure 4:
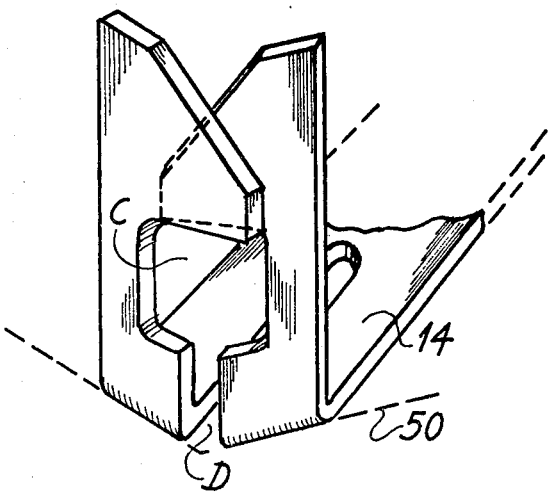
FIG. 4 shows yet another embodiment of the contact element according to the invention comprising a ring with an overlapping opening.

FIG. 4 shows another variant of the radial anchoring fork according to the invention.

In this variant, the two branches of the fork, in a projection perpendicular to their plane, have a common part like the blades of a pair of scissors. Radial anchorage is obtained in the same way as in the embodiment described above, although it is pointed out that this anchorage is obtained even if the opening of the ring intended to accommodate the wire is larger than the cross-section of the wire. Folding in the form of a V at 50 may be advantageous.

The self-stripping contact element according to the invention can be produced on an industrial scale by folding as illustrated in FIG. 2.

It can be seen from FIG. 2 that the portion rear of the contact element comprises the first two walls formed by folds at 24, 25 and 26 in the strip 14 extending the front portion of the contact element and, in succession, the third wall 10 obtained by folding the strip 14 through 90° at 27.

This particular technique of cutting and folding provides the transverse walls with high mechanical resistance to the various stresses both axial and radial, the deformation-resistant sections being larger than in the prior art.

What is claimed is:

1. A contact element for connectors, for connecting wires covered by an insulating coating comprising:

a front portion for ensuring contact with a complementary contact element belonging to another circuit;

a rear portion for ensuring connection with one of said wires;

said rear portion having a plurality of open slots of different widths for self stripping and connecting to said one of said wires by introduction of said one of said wires into said slots, said rear portion comprising successive first, second, and third parallel walls respectively having first, second, and third ones of said plurality of slots for respectively providing electrical connection, mechanical stability to axial stresses, and mechanical stability to radial stresses, said third slot having a top part for receiving said one wire and a wire holding part, said third slot having, for shaping said one of said wires, a shaping part having a width smaller than the diameter of said one of said wires, opening at opposite ends thereof into said holding part and said top portion, respectively, wherein the portions of the two sides of said third wall on opposite sides of the shaping part of said third slot partly overlap one another.

2. A contact element as claimed in claim 1, in which the portions of the two sides of said third wall on opposite sides of said shaping part of said third slot, partly overlap one another, wherein, for the introduction of said one of said wires, said third slot top part has a V shape.

3. A contact element as in claim 1, wherein said third slot comprises a bottom part, opening into said holding part opposite said shaping part, having a given length, said given length determining the elastic return force pulling the two opposite sides of said third slot together when said sides are drawn apart.

4. A contact element as in claim 3, wherein said holding part has a polygonal contour.

* * * * *